US005195164A

United States Patent [19]

Lambert

[11] Patent Number: 5,195,164

[45] Date of Patent: Mar. 16, 1993

[54] ELECTRIC HEATER/BLOWERS WITH SELECTIVELY-LOCKED OUTPUT VARIABLE HEAT AND BLOWER CONTROLS

[76] Inventor: William S. Lambert, 52 Tokalon Pl., Metairie, La. 70001

[21] Appl. No.: 525,194

[22] Filed: May 17, 1990

[51] Int. Cl.[5] ..... H05B 1/02; F24H 3/04; A45D 20/10; H01H 9/06

[52] U.S. Cl. ..... 392/385; 34/97; 34/243 R; 200/318.2; 219/240; 219/533

[58] Field of Search ..... 219/240, 533; 392/379-385; 34/96-101, 243 R; 200/332.2, 522, 318.1, 318.2, 321

[56] References Cited

U.S. PATENT DOCUMENTS

| | | | |
|---|---|---|---|
| 3,378,662 | 4/1968 | Sorenson | 200/522 |
| 3,781,579 | 12/1973 | Rosenthal et al. | 200/318.1 |
| 4,003,388 | 1/1977 | Nopanen | 392/384 X |
| 4,013,083 | 3/1977 | Helbling | 392/380 X |
| 4,196,343 | 4/1980 | Han | 392/385 |
| 4,271,342 | 6/1981 | Sistare | 200/332.2 |
| 4,296,290 | 10/1981 | Peot | 200/522 |
| 4,683,369 | 7/1987 | Rieckman et al. | 392/385 |
| 4,711,988 | 12/1987 | Thaler et al. | 392/385 X |

*Primary Examiner*—Anthony Bartis

[57] ABSTRACT

An electric hot air blower has a casing having a discharge portion containing a heating element and variable speed motor driven air blower and provided with a pistol grip handle for manipulation of hot air blower. A pair of pivotally mounted triggers frontally positioned in vertically spaced relationship in the center of the pistol grip handle selectively operate respective ones of a pair of spring-biased open incremental switches disposed in the handle for variably controlling the air blower motor speed in concert with the intensity of the heating element. The triggers are lockable in a selected position between an off and the maximum position of the incremental switch actuated thereby by a releasable locking button engageable with locking teeth on the trigger.

1 Claim, 5 Drawing Sheets

ELECTRIC HEATER/BLOWERS WITH SELECTIVELY-LOCKED OUTPUT VARIABLE HEAT AND BLOWER CONTROLS

BACKGROUND

1. Field of the Invention:

The concept of methodic air blown heat application to varied objects and materials has been utilized for decades, manifesting a very crowded field, basically unchanged over time until the present invention, which now presents a major, novel refinement allowing for a quantum leap in skillful, artful control in dexterous intensity-manipulation throughout the course of the application of air blown heat and the improved effect resulting therefrom.

2. Summary, Objects and Advantages of the Invention:

The primary objective/advantage is more precisely regulated, simultaneous manipulation of the intensity of the forced air and heat from the unit/source and thus, more specifically controlled end results therefrom. This accuracy is critical in so-processing countless relevant objects and materials, including but not limited to: appliques, coatings, films, heat-pliant materials, etc. While the varied applications of air blown heat could fill volumes, in the interest of brevity and a more specific illustration, the standard hair dryer will serve to be utilized as one optimum embodiment of this process. On these units available today (see the heater blower having handle 53, blower 52, nozzle 50 and power cord 54 in FIG. 5) to accomplish a smooth and fluent application of air blown heat, the process (relatively awkward digitally) must be momentarily interrupted to adjust the intensity of either. The art of hair styling is primarily accomplished by skillful air blown heat application in concert with hairbrush and comb function—additive hair conditioners aside. The more naturally operating trigger/switching of the instant invention facilitates uninterrupted and continuous styling manipulation, permitting freer artistic expression. Experience with hair dryer use teaches the consequences to hair behavior of either excess heat and/or maladjusted blown air intensity. Unquestionably, hair styling is a delicate art form and this tool improvement greatly facilitates that talent. "Frizzly" hair results from overheating and "fallen" hair styling can result from still-damp hair body. Unwanted curling tendency can be accented or practically eliminated with heat blown air by temporarily counter-brushing the hair direction, ("spray netting" in some cases) and thereafter heat blown into the finished style intended. The meticulously precise, simultaneous control permitted the user insures the desired end result. The varied length and hair concentration in selected areas of the same scalp demand split-second blown heat adjustment to accomplish the intended styling. The smooth flowing adjustability—incorporating the most simple, optimally natural digital movement, and resulting control of the blown heat allows this accommodation.

An optional flexible grip/strap to aid digital conformity is attached to the handle/grip and the adjustability (to fit user's hand) of the grip/strap acts to prevent accidental dropping of the unit. These accidental drops usually result in irreparable damage to the unit and, in the case of home hair dryers, sometimes even death by electric shock when dropped in water contained in toilet bowls, lavatories, and bath tubs.

Optimum, complementary precision/response is allowed by the digital, dexterous manipulation permitted by the particular arrangement of the pivoted pendulum-type, heat and blower trigger-switches. The instantaneous precision so-allowed produces enhanced end-result and mechanically forestalls hand/wrist fatigue and is applicable to most hand-held, heat/blower-device/processes.

DESCRIPTION OF THE PREFERRED EMBODIMENT OF THE INVENTION

Irrespective of the rated capacity of either, a fan/-propeller driven by a variable-speed motor forces air over an adjustable-intensity heating element or coil. The two are usually encompassed in a confined area—a tube or barrel conduit—thru which as-yet untreated air is drawn in thru an intake aperture and propeller-blown over a heating element or coil and thus heated, is blown out thru a discharge aperture.

Figure 1:
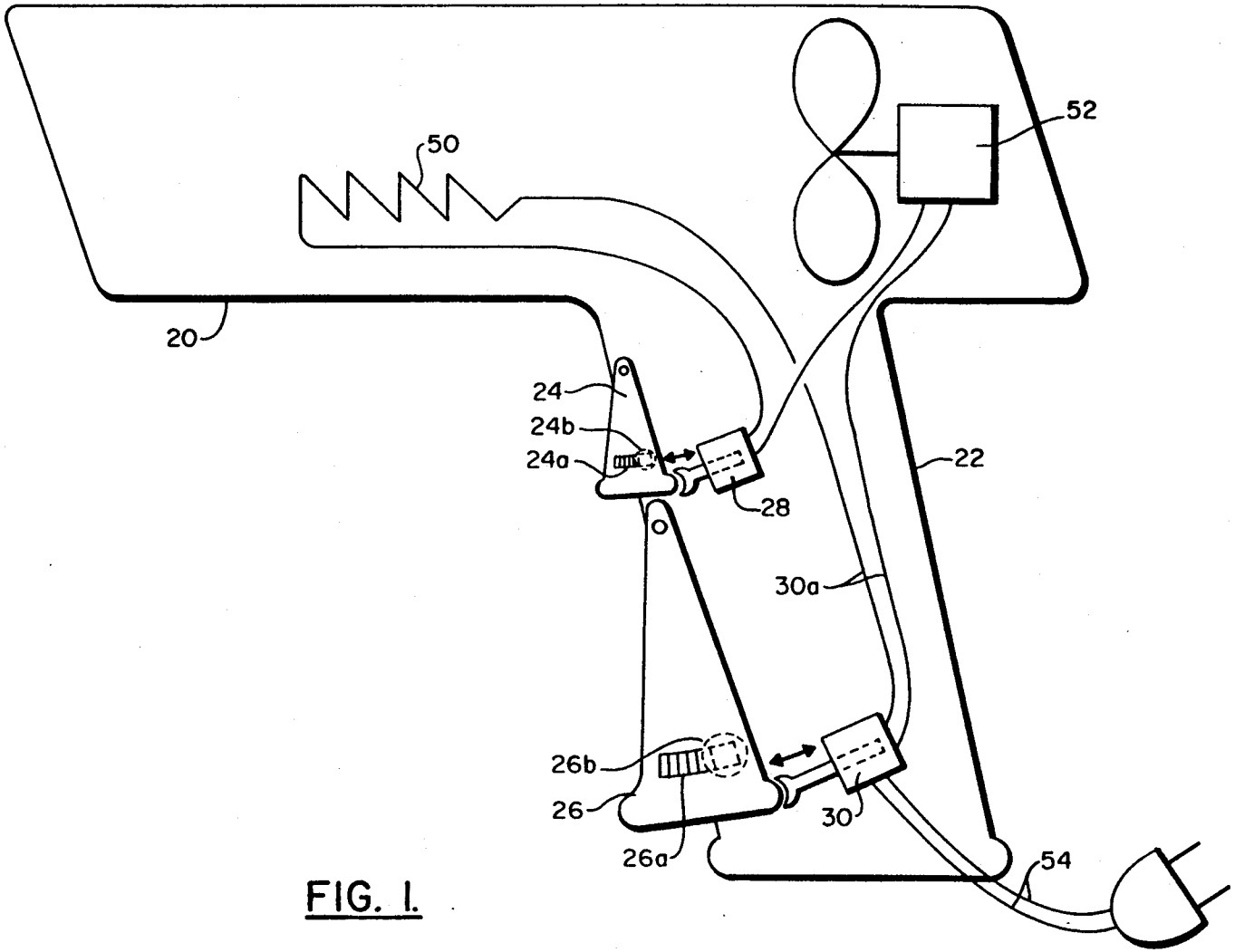
FIG. 1 is a schematic left side view of the hot air blower of the invention showing the principle operational parts thereof.
Figure 2:
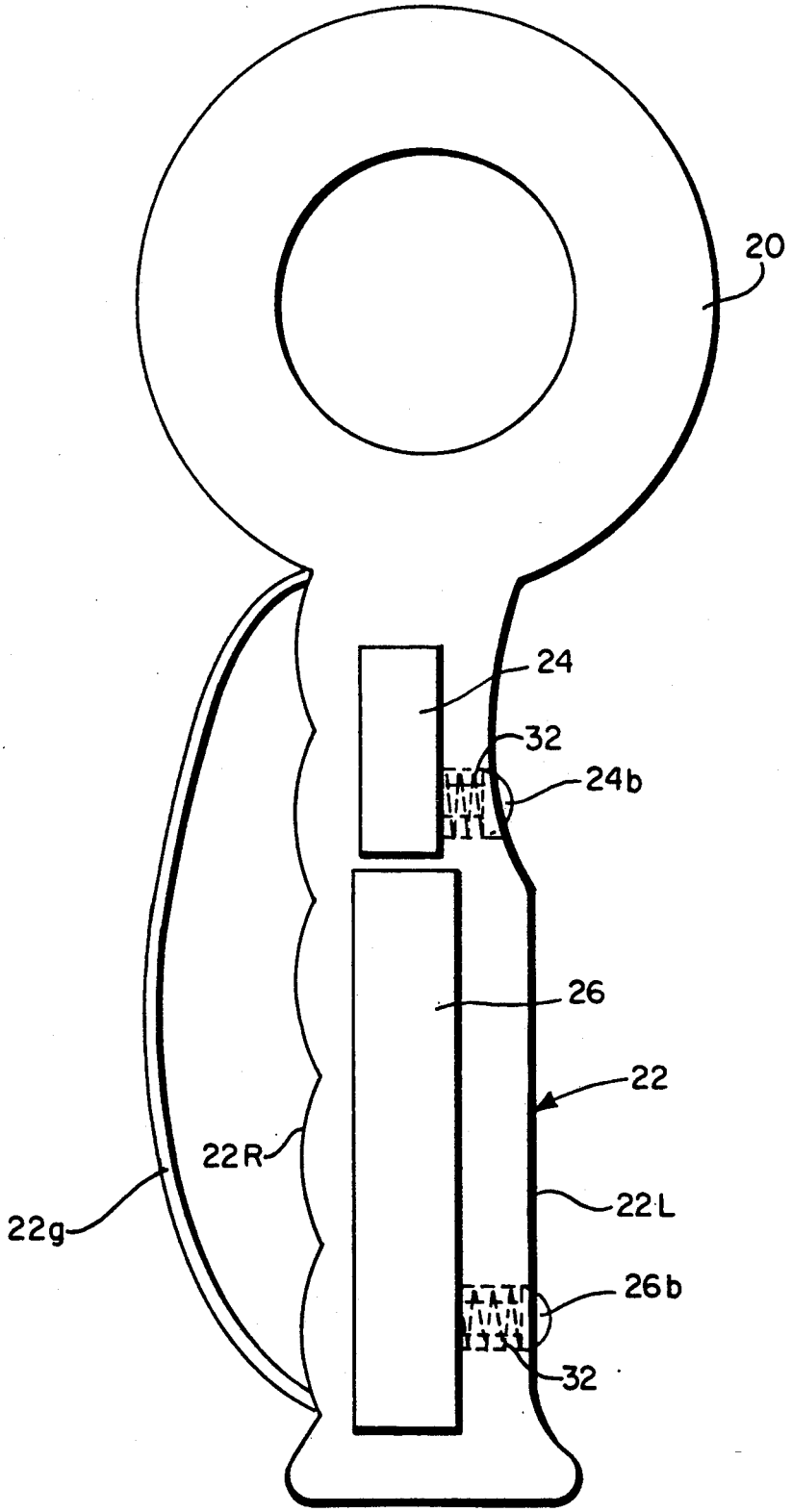
FIG. 2 is front view of the hot air blower showing the trigger arrangement and the optional grip/strap.
Figure 3A:
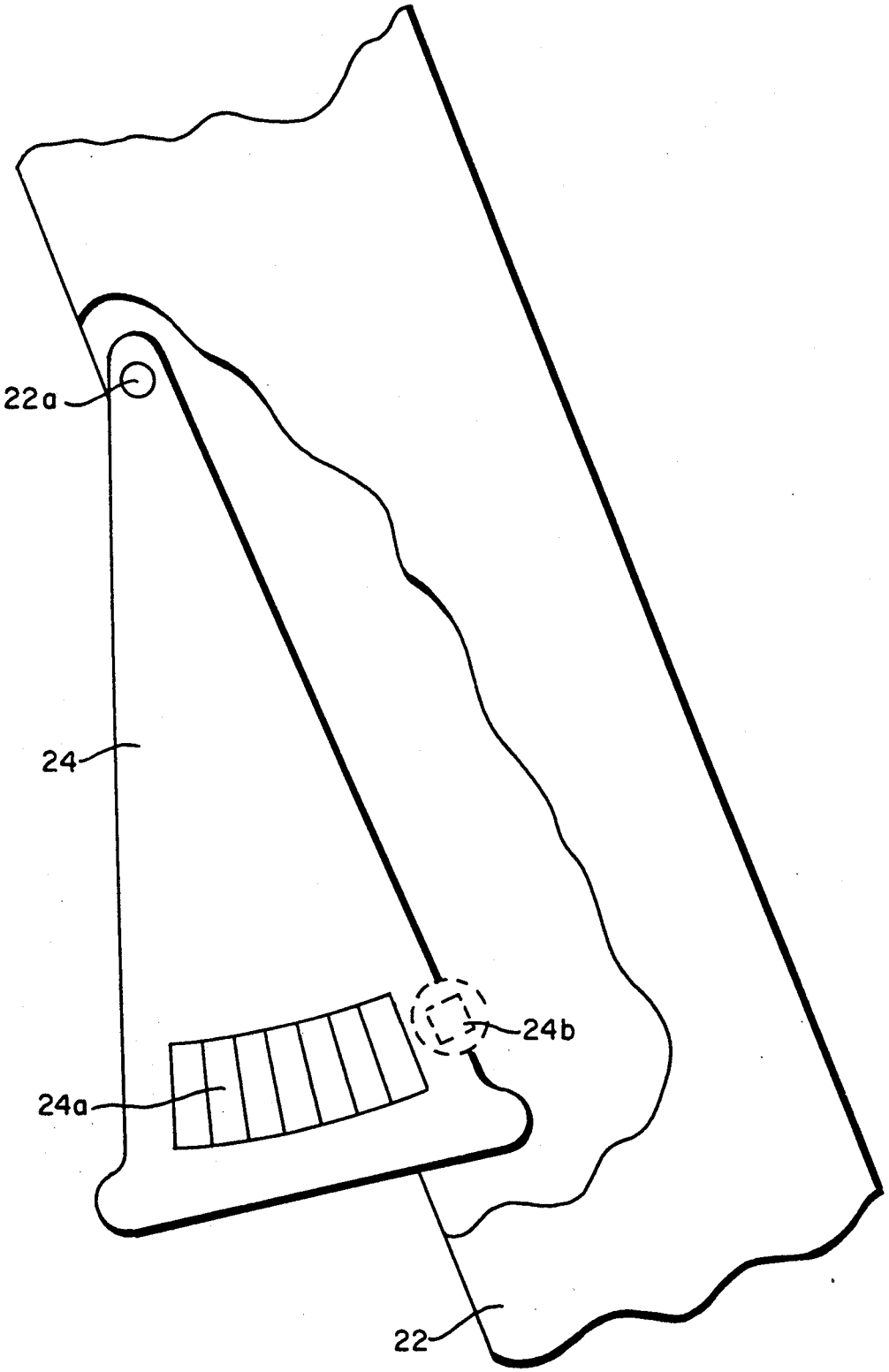
FIG. 3A is a broken away view of the handle of the hot air blower showing the pivoted trigger and locking teeth thereon.
Figure 3B:
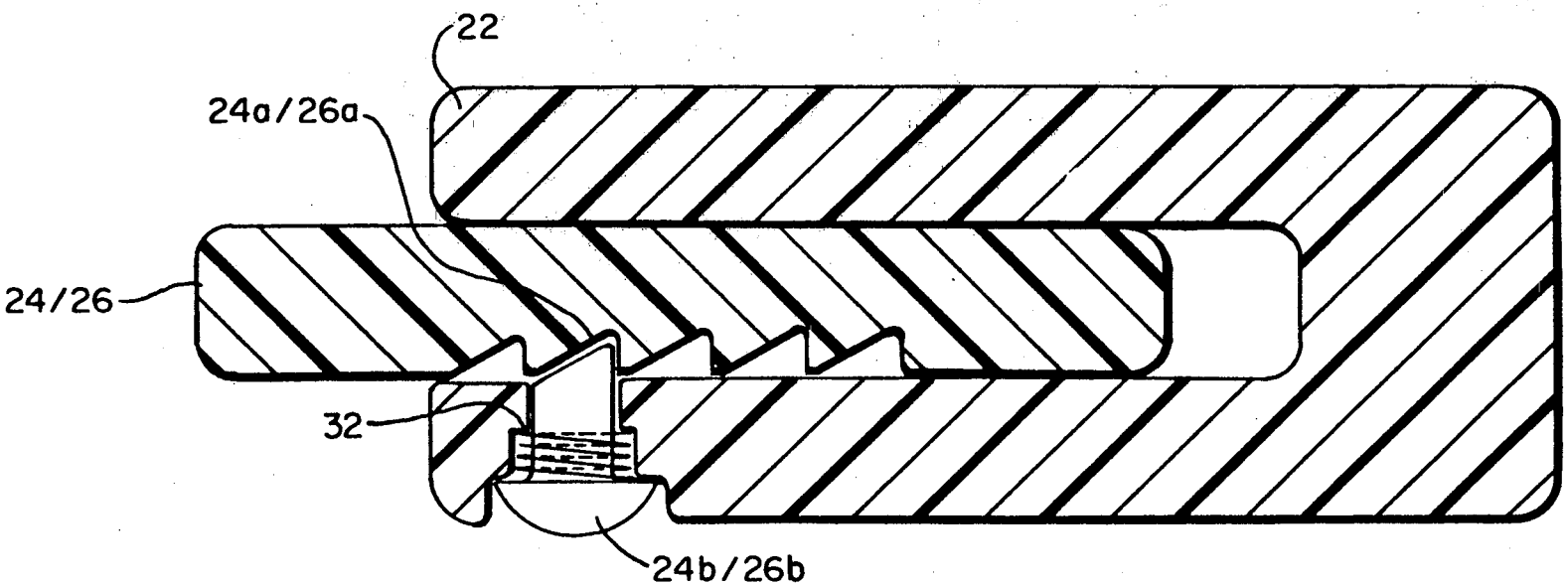
FIG. 3B is a sectional view through the handle, showing the relationship of the trigger locking teeth to the locking pin.
Figure 4:
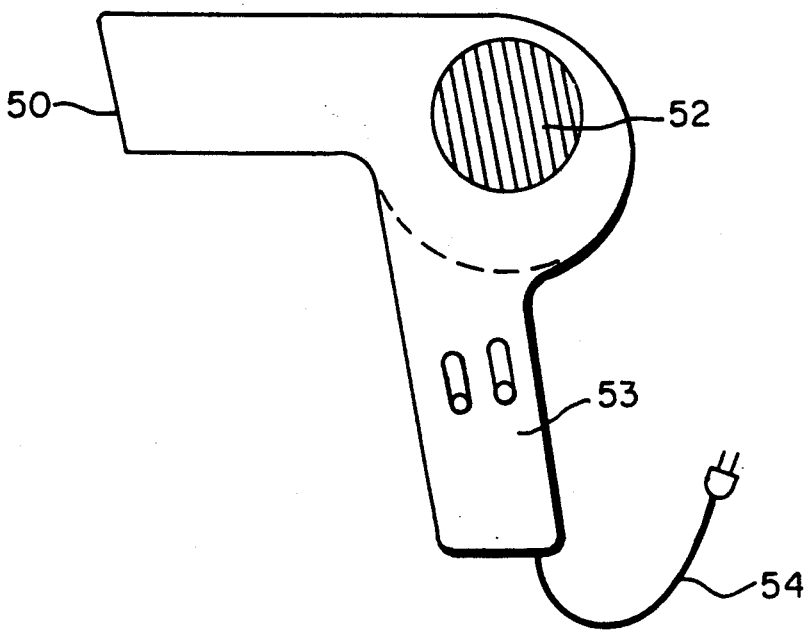
FIG. 4. PRIOR ART
FIG. 4 is a side view of a heater blower according to the prior art.

This invention deals with the method of simultaneously controlling the intensity of the electrically powered blower/motor and heating element. This arrangement is best illustrated thru the hair dryer (FIG. 1) embodiment as an example—specifically, with those controls are located on the front side of the usually plastic pistol handle grip 22 of the unit. These two components are activated by fan blower trigger 26 and heat trigger 24. The triggers 24 and 26 actuate similar rebound/spring-loaded, graduated intensity switches 28 and 30, respectively capable of controlling the blower motor 52 and heating element 50 in discharge portion 20 thru electrical wire interconnections connected to power cord 54. Their electrical output ranges from off, or zero, on up to full intensity. These similar pendulum-like triggers 26/24, axle-pinned on the upper portion, are normally free-moving. The heat intensity trigger 24 is positioned vertically just above fan blower trigger 26, along the centerline of the frontal face of the handle grip 22 to facilitate digitally fluid manipulation of the integration of the output from both. The lower part is so shaped, when compressed, to mate with, activate and thus energize the respective switches(standard off-the-shelf item) 28/30. The switch rebound innerspring returns the trigger 24/26 (thus the switch power setting) to zero/off when released. A square, spring-biased, button/pin **24*b*/26*b*, attached to and thru the side of the handle/grip 22, can be depressed and with a wedging action can lock its male chisel-point 24*b*/26*b* into one of a plurality of female wedge/teeth 24*a*/26*a* to secure trigger 24/26 at the desired switch intensity/power. Configuration of the wedging action 24*a*/24*b*** or, 26a/26b allows for disengagement of the chisel-point 24b/26b and the wedge/teeth 24a/26a upon recompression of the trigger 24/26. The button/pin 24b/26b rebound innerspring 32 thus inherently releases said button/pin 24b/26b. Switches 28 and 30 return to an inactivated position. Unit handle/grip can be optionally configured to accommodate fingers on one side 22R and thumb on the other side 22L. An optional, flexible grip/strap 22g(to pass over and secure the hand about at the knuckles) is fix-connected at location on upper handle/grip 22 and once adjusted to user's desire, is then fixed in place by being pinned to a location on lower handle/grip.

How the Invention Works

Precise and meticulous manipulation of air blown heat applied to various objects and materials thru instantaneous, uninterrupted simultaneous control is provided by the selective locking of the position of the triggers, 24 and 26. This fluid application is accomplished through the ease and responsiveness of the heat and blower speed intensity triggers 24/26 located in the frontal center of the handle/grip 22 of such a heat/-blower unit. Standard(off-the-shelf), graduated(off to full power), rebound/spring-loaded electrical switches 28/30 are activated by free swinging trigger 24/26 compression. In turn, compression of switches 28 and 30 varies the air flow intensity, along with the heat intensity. The pin/wedge locking arrangement 24a, 24b, 26a, 26b permits a locking-in of any given intensity range setting of the heat and air flow. Power must be initiated through the fan/blower to power heating element to preclude possibility of fire.

Optimal finger and thumb accommodation deformations 22R/22L may be formed on the handle/grip 22 as an option when handle/grip is fabricated. An adjustable fixed, flexible grip/strap 22g to encompass and secure operator's hand to handle/grip 22 is another option. Both additions greatly increase operator control/-manipulation as well as to prevent accidental dropping of the unit.

Conclusion

The trigger arrangement 22, 24, disclosed, represents a new approach to optimum sharpening of the intensity of the air flow and heat which governs the objective end-result of the process of a multiplicity of air blown heat applications. Some, but not limited to, procedures enhanced by the precision of this process are the following: model building, varied art forms, paintings and coatings, diffuse man-made fabrications, most heat-gun treatments, gluing processes, animal grooming, films, heat-pliant materials, facial appliques, etc. The critical blown air/heat factor in both at home and beauty parlor, hair drying is discussed in the foregoing text.

In short, the novel arrangement of the blower/heat controls facilitate the maximum, optimum, dexterous manipulation of these subject effects and its end results.

What is claimed is:

1. In a hot air blower having a discharge portion containing an electric heating element and a variable speed motor driven air blower arranged to direct air over the heating element to be heated, and a pistol handle grip for manipulating the hot air blower during use, the improvement comprising means for simultaneous regulation of the heat output intensity of the heating element and the speed of the air blown over the heating element by the air blower, said means comprising, a pair of pivotally mounted triggers frontally positioned in the center of the pistol handle grip in vertically spaced relationship, a pair of incremented, spring-biased open switches disposed in said pistol handle grip and each positioned so as to be actuable by respective ones of said triggers, said triggers being biased to the off position of the switches by the spring-bias of the switches, said switches being arranged respectively to energize and variably control the air blower motor speed in concert with the intensity of the heating element, means for selectively locking each of the triggers in an selected position between a off and the maximum position of the incremental switch actuated by the trigger, said locking means comprising a pair of spring-biased locking buttons on the side of the handle grip and each arranged to interact with a selected one of a plurality of respective ones of teeth provided in the side of the trigger to releasably lock the trigger operative in a selected position until manually released by further movement of the trigger.

* * * * *